US008905253B2

(12) United States Patent
Mooney

(10) Patent No.: US 8,905,253 B2
(45) **Date of Patent: *Dec. 9, 2014**

(54) CONTAINER HAVING VACUUM COMPENSATION ELEMENTS

(75) Inventor: Michael R. Mooney, Frankfort, IL (US)

(73) Assignee: Plastipak Packaging, Inc., Plymouth, MI (US)

( * ) Notice: Subject to any disclaimer, the term of this patent is extended or adjusted under 35 U.S.C. 154(b) by 945 days.

This patent is subject to a terminal disclaimer.

(21) Appl. No.: 12/595,723

(22) PCT Filed: Apr. 16, 2008

(86) PCT No.: PCT/US2008/060454

§ 371 (c)(1),
(2), (4) Date: Apr. 22, 2010

(87) PCT Pub. No.: WO2008/130987

PCT Pub. Date: Oct. 30, 2008

(65) Prior Publication Data

US 2010/0219153 A1 Sep. 2, 2010

Related U.S. Application Data

(60) Provisional application No. 60/912,064, filed on Apr. 16, 2007.

(51) Int. Cl.

| | |
|---|---|
| ***B65D 90/02*** | (2006.01) |
| ***B65D 79/00*** | (2006.01) |
| ***B65D 1/02*** | (2006.01) |

(52) U.S. Cl.

CPC ..... *B65D 1/0223* (2013.01); *B65D 2501/0081* (2013.01); *B65D 79/005* (2013.01); *B65D 2501/0036* (2013.01); *B65D 2501/0027* (2013.01)

USPC ..... 215/381; 215/382; 215/384

(58) Field of Classification Search

USPC ..... 215/382, 384, 381

See application file for complete search history.

(56) References Cited

U.S. PATENT DOCUMENTS

| | | | | | |
|---|---|---|---|---|---|
| D91,063 | S | * | 11/1933 | Fuquen | D9/562 |
| D100,054 | S | * | 6/1936 | Smith, Jr. | D9/563 |
| 3,212,661 | A | * | 10/1965 | Adell | 248/313 |
| 4,749,092 | A | | 6/1988 | Sugiura et al. | |
| 4,818,575 | A | * | 4/1989 | Hirata et al. | 428/36.7 |
| 5,101,990 | A | * | 4/1992 | Krishnakumar et al. | 215/383 |
| 5,141,120 | A | | 8/1992 | Brown et al. | |
| 5,141,121 | A | | 8/1992 | Brown et al. | |

(Continued)

FOREIGN PATENT DOCUMENTS

| | | |
|---|---|---|
| JP | S55-179110 | 12/1980 |
| JP | H04-10011 | 1/1992 |

(Continued)

OTHER PUBLICATIONS

U.S. Appl. No. 12/595,729, filed Apr. 15, 2010, Mooney, M. R.

*Primary Examiner* — Tri Mai

(74) *Attorney, Agent, or Firm* — Dykema Gossett PLLC

(57) ABSTRACT

A lightweight container includes an enclosed base, an upper portion that extends upwardly to a finish; and a body located between the base and the upper portion. The sidewall includes vacuum compensation elements that have an open end and an opposing closed end, and that form a V-shape. Each element has nested fields.

24 Claims, 11 Drawing Sheets

(56) References Cited

U.S. PATENT DOCUMENTS

| | | | | |
|---|---|---|---|---|
| 5,908,128 | A | 6/1999 | Krishnakumar et al. | |
| 6,662,960 | B2 | 12/2003 | Hong et al. | |
| 6,779,673 | B2 | 8/2004 | Melrose et al. | |
| 6,796,450 | B2 | 9/2004 | Prevot et al. | |
| 6,923,334 | B2 | 8/2005 | Melrose et al. | |
| 7,137,520 | B1 | 11/2006 | Melrose | |
| D571,667 | S * | 6/2008 | Bourne | D9/539 |
| D601,030 | S | 9/2009 | Lepoitevin | |
| 7,581,654 | B2 | 9/2009 | Stowitts | |
| D602,783 | S | 10/2009 | Lepoitevin | |
| 8,267,266 | B2 * | 9/2012 | Mooney | 215/382 |
| 2004/0195200 | A1 | 10/2004 | Bourque et al. | |
| 2005/0121408 | A1 | 6/2005 | Deemer et al. | |
| 2005/0218108 | A1 | 10/2005 | Bangi et al. | |
| 2006/0070976 | A1 * | 4/2006 | Ungrady | 215/381 |
| 2006/0076310 | A1 | 4/2006 | Mooney et al. | |
| 2007/0012649 | A1 | 1/2007 | Kamineni et al. | |
| 2007/0075031 | A1 * | 4/2007 | Tanaka et al. | 215/382 |

FOREIGN PATENT DOCUMENTS

| | | |
|---|---|---|
| JP | 10-230919 | 9/1998 |
| JP | 2005-343474 | 12/2005 |
| JP | 2006-327638 | 12/2006 |
| WO | WO 99/57021 | 11/1999 |
| WO | WO 2008/130987 | 10/2008 |
| WO | WO 2008/130996 | 10/2008 |

* cited by examiner

CONTAINER HAVING VACUUM COMPENSATION ELEMENTS

CROSS-REFERENCE TO RELATED APPLICATIONS

This application is the National Stage of International Application No. PCT/US 2008/060454, filed Apr. 16, 2008, which claims the benefit of U.S. Provisional Application No. 60/912,064, filed Apr. 16, 2007, the disclosures of which are incorporated herein by reference in their entirety.

BACKGROUND

This invention relates to containers, and more particularly to plastic containers capable of flexing in response to changes in internal pressure.

Plastic containers for perishable products are often filled at an elevated temperature in a process generally known as hot-filling, which includes filling the product at about 185 degrees F. and immediately sealing the container. After sealing, the contents of the container contract upon cooling, which creates a vacuum condition inside the container.

Many conventional cylindrical containers would deform or collapse under the internal vacuum conditions without some structure to prevent it. To prevent collapse, some containers have panels, referred to as "vacuum panels," located in the panel sidewall. The vacuum panels are configured to inwardly and easily flex in response to internal vacuum such that the remainder of the container body remains cylindrical. The structure between the vacuum panels, such as vertical posts, is stiff relative to the vacuum panels. Often, the vacuum panels are located about the circumference of the body of the container and then covered by a label that wraps around the circumference to hide the vacuum panels and posts.

Other hot-fill containers have a pair of opposing vacuum panels that incorporate handgrips, which usually are not covered with a label panel to enable gripping. Rather, other portions of the container, such as the cylindrical segments between the handgrips, provide a label surface.

The vacuum panels of many bottles are generally rectangular. Often, deformation of a generally rectangular vacuum panel causes high stress areas at the corners and in the areas outside the vacuum panels near the corner.

There is a need for improved containers that are lightweight and capable of withstanding hot-filling conditions.

SUMMARY OF THE INVENTION

A container is provided that includes an enclosed base, an upper portion that extends upwardly to a finish; and a body located between the base and the upper portion. The body includes a sidewall having at least one vacuum compensation element generally having a V-shape. The element comprises a first field, a second field, and a third field. The first field is nested within the second field, and the second field is nested within the third field. The elements are closed on one of an upper end and a lower end and generally open on the other one of the upper end and the lower end.

According to another aspect, a plastic hot-fill bottle may include: an enclosed base, an upper portion that extends upwardly to a finish, and a body located between the base and the upper portion. The body includes a sidewall having at least one circumferentially spaced, vacuum compensation elements. Each one of the elements comprises a first field, a second field, and a third field. The first field is nested within the second field, the second field is nested within the third field. The elements are generally enclosed on one of an upper end and a lower end and generally open on the other one of the upper end and the lower end. The element open end smoothly merges into the container sidewall. The elements may be V-shaped.

According to another aspect, a plastic hot-fill bottle may include: an enclosed base, an upper portion that extends upwardly to neck and a finish, and a body located between the base and the upper portion. The body includes a sidewall comprising: at least two vacuum compensation elements, and at least two panels, wherein the elements and panels are disposed around the circumference of the body in an alternating manner, and wherein the vacuum compensation elements have a generally V-shape. The elements comprise: a first field, a second field, and a third field. The first field is nested within the second field, and the second field is nested within the third field. The elements are generally closed on one of an upper end and a lower end and generally open on the other one of the upper end and the lower end.

For each of the aspects or structures described above, a label panel may be provided that is spaced apart from the elements. Preferably, the container has an even number of circumferentially spaced, vacuum compensation, flared elements, which may provide enhanced support of the sidewall. Ribbed or stepped eyebrows may be located adjacent to the closed end of a field. Each field or element may include a tip, transition portions, and lateral portions that are defined by ridges. Preferably, each one of the fields forms a face that is overall flat. The container may have, for example, four elements such that the container body is approximately square in transverse cross section before and after hot-filling. The body of the container may be label-less. The panels may be concave and adorned with an ornamental feature.

The inventors have found that container shown in the figures can be made lightweight. The body of the container may optionally function as a gripping surface that is label-less the label panel provides a surface for receiving the label. The gripping surface is enhanced by the field geometry.

BRIEF DESCRIPTION OF PREFERRED EMBODIMENTS

Figure 1:
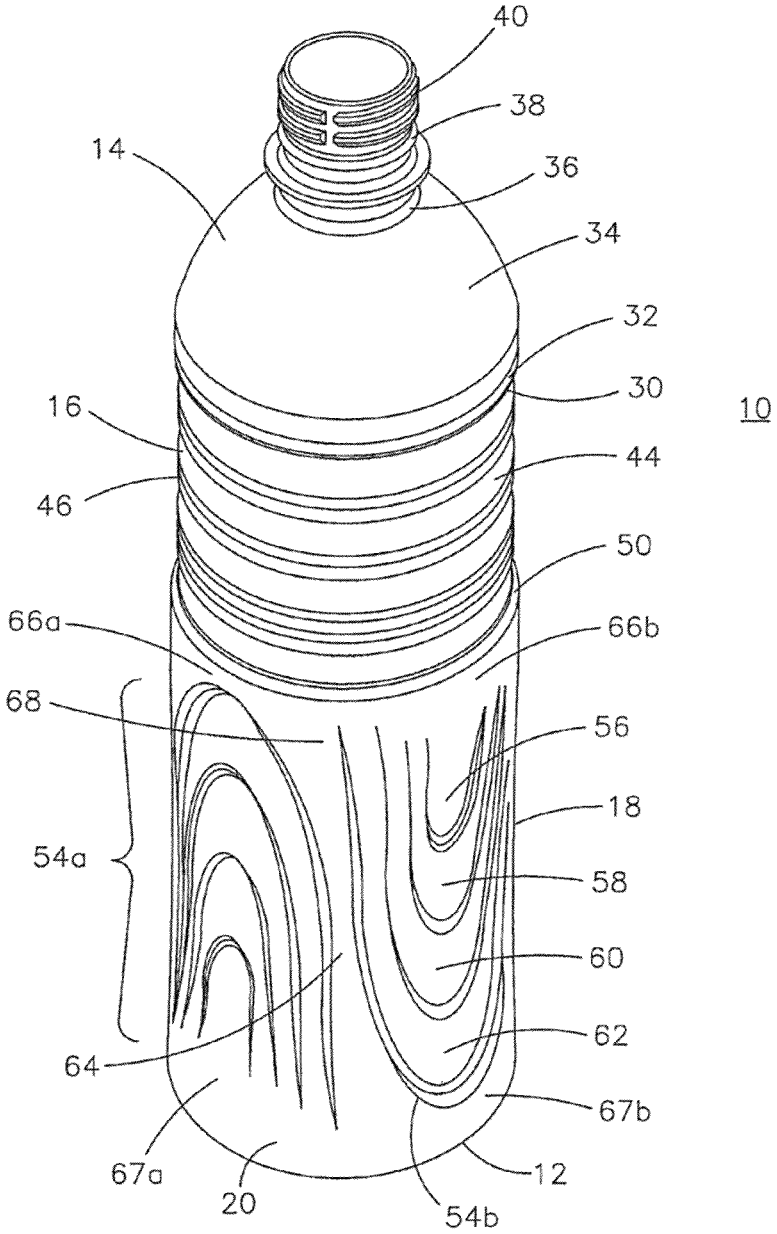
FIG. 1 is a perspective view of a container illustrating aspects of the present invention.

Container 10 is capable of being hot filled and includes an enclosed base 12, an upper portion 14, a label panel 16, and a body 18. Base 12 preferably is circular and includes a circumferential heel 20, a standing ring 22, and a reentrant portion 24. Heel 20 extends downwardly from body 18 to the circular standing ring 22. Preferably, body 18 smoothly yields to heel 20, and the present encompasses additional structure (not shown in the figures), between body 18 and heel 20. Reentrant portion 24 may be of any type. For example, reentrant portion 24 may include conventional, radial reinforcing ribs, may be rigid or configured to deform in response to internal vacuum and function with the vacuum compensation features of container 10, or may comprise other structure.

Upper portion 14 includes an upper label bumper 30, a cylindrical portion 32, a dome 34, a neck 36, and a finish 38 that includes threads 40. Upper label bumper 30 defines the boundary of label panel 16. Cylindrical portion 32 preferably is short relative to the vertical length of dome 34, which extends upwardly and inwardly to neck 36. The present invention also encompasses containers having a large mouth (not shown in the figures). Threads 40 receive corresponding threads of a closure (not shown in the figures) upon hot-filling.

As shown in FIG. 1, label panel 16 extends from upper bumper 30 to a lower bumper (described below) and preferably is cylindrical to enable a label to be applied around its circumference. Label panel 16 may optionally includes ribs 46, which are shown in FIG. 1, to enhance the hoop strength and ovality (that is, inhibit or diminish ovality). In this regard, the container having ribs 46, as shown in FIG. 1, is illustrated with the reference numeral 10' to distinguish it from container 10 that has no ribs. The body 18 of container 10 is the same as that of container 10'. Reference to container 10 in the description in this specification refers both to containers 10 and 10' unless expressly stated otherwise. A portion of a label 17 is shown schematically in FIG. 2.

Figure 2:
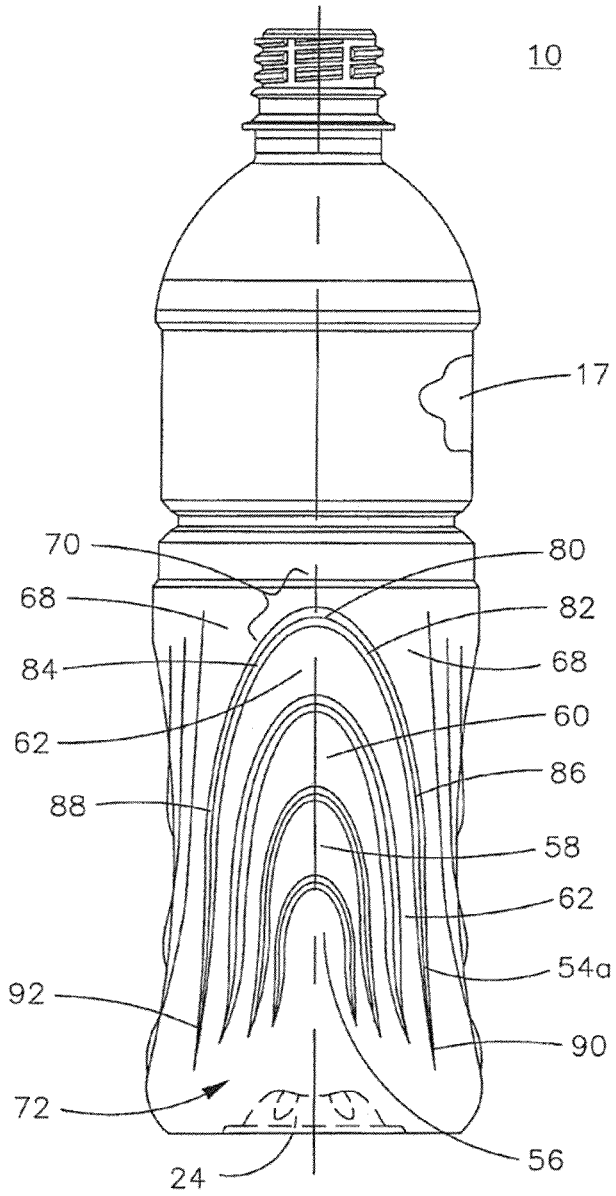
FIG. 2 is an elevational view of another container illustrating aspects of the present invention.
Figure 3:
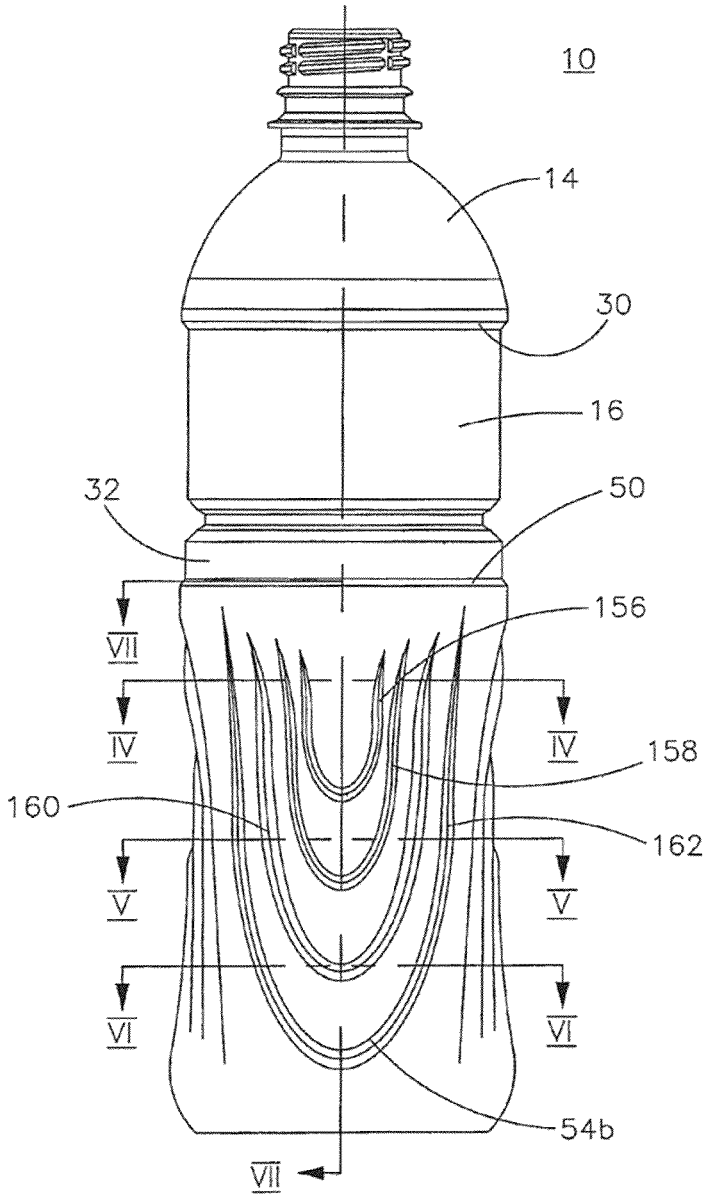
FIG. 3 is another elevational view of the container shown in FIG. 2.
Figure 4:
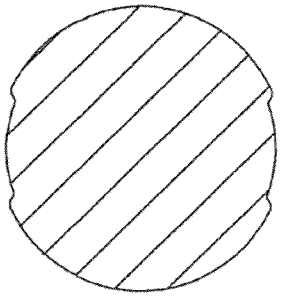
FIG. 4 is a transverse cross section taken through lines IV-IV shown in FIG. 3.
Figure 5:
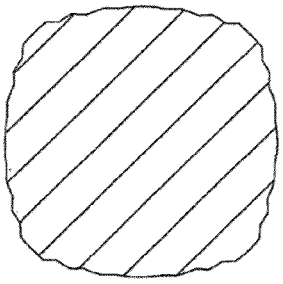
FIG. 5 is a transverse cross section taken through lines V-V shown in FIG. 3.
Figure 6:
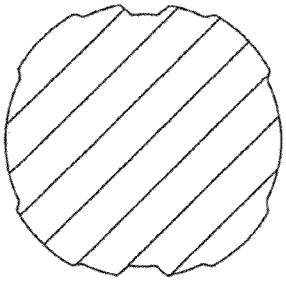
FIG. 6 is a transverse cross section taken through lines VI-VI shown in FIG. 3.

Body 18 includes a sidewall 48, the lower label bumper 50 at its upper end, and four vacuum compensation elements 54, which each includes a group of fields. The element shown in full view in FIG. 2 will be referred to as upwardly oriented and as element 54*a* for description purposes. Its adjacent elements will be referred to as downwardly oriented and as element 54*b*. As shown in the embodiments of FIGS. 1, 2, and 3, upwardly oriented element 54*a* has a downwardly oriented element 54*b* on each side, and each downwardly oriented element 54*b* has an upwardly oriented element 54*a* on each side.

The shape of elements 54*a* is referred to herein as a V-shape, and the term V-shaped encompasses a closed end 70 that is pointed, a circular arc, or other curved shape having a curvature smaller or larger than that of a circular arc. The term V-shape encompasses any shape having one end that narrows relative to its midsection or generally considered to constitute a "V", and also encompasses sides that are mutually parallel or that extend outwardly from closed end 70. The invention also encompasses elements that do not have a V-shape, according to the particular language of the claims.

As shown in the Figures, each element 54*a* includes or is defined by a rounded tip 80, a pair of opposing curved transition portions 82 and 84 that extend outwardly and downwardly from the tip 80, a pair of lateral portions 86 and 88 that extend generally downwardly from transition portions 82 and 84, and a pair of end portions 90 and 92 that flare outwardly from lower ends of lateral portions 86 and 88. Tip 80 and transition portions 82 and 84 define a closed end 70. The spaced apart end portions 90 and 92 define an open end 72.

Each element 54 may include a first field 56, a second field 58, and a third field 60, and a fourth field 62. Preferably, each field has a ridge separating it from adjacent fields. For example, first field 56 may have a ridge 156 that defines the perimeter of a portion of field 56 and opens to element open end 72. Second field 58 may have a ridge 158 that defines the perimeter of a portion of field 58 and that opens to element open end 72. Likewise, third field 60 may have a ridge 160 that defines the perimeter of a portion of field 60 and also opens to element open end 72. And fourth field 62 has a ridge 162 that, in the embodiment shown in the figures, defines the outer boundary of the vacuum compensation element 54.

First field 56 is fit into the open end of second field 58 and is thus nested with second field 58. Preferably, the majority of the relatively flat surface of first field 56 is located within the ridge 158 that defines second field 58. Similarly, the majority of the relatively flat surface of second field 58 is located within the ridge 160 that defines third field 60 and the majority of the relatively flat surface of third field 60 is located within the ridge 162 that defines fourth field 62. In the embodiment shown in the figures, the entire area of the flat surfaces is located within the ridge of its corresponding superior field. Preferably, the surface of each of the fields is generally flat in its as-molded state. The boundary of each of the fields has the same general shape as the boundary of the outer field (that is, of the fourth field 62 in the embodiment shown in the Figures).

Figure 7:
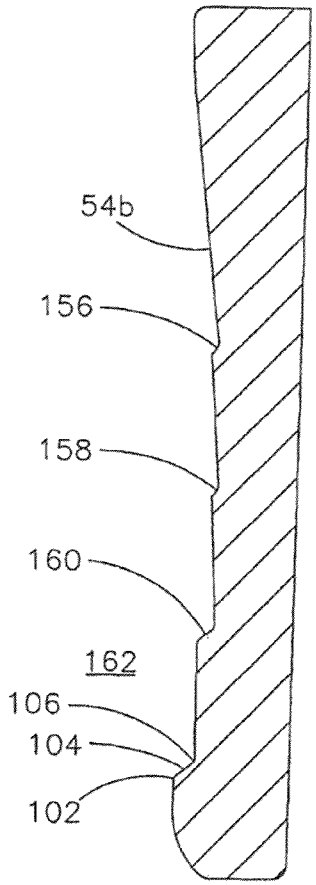
FIG. 7 is an enlarged longitudinal cross section taken through lines VII-VII shown in FIG. 3.
Figure 8:
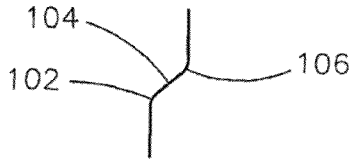
FIG. 8 is an enlarged view of a portion of FIG. 7.

Each ridge may have a configuration that is designated by reference numeral 100 and may apply to each ridge 156, 158, 160, and 162. FIG. 8 schematically shows the portions of ridge 100, in longitudinal cross section, that includes an outer portion 102, a midsection 104, and an inner portion 106. Ridge inner portion 106 forms a transition between the large, relatively flat surface of its field to midsection 104. Preferably, each midsection 104 is outwardly and downwardly sloped for downwardly oriented elements 54*b* (as shown in FIGS. 7 and 8) and outwardly and upwardly sloped for upwardly oriented elements 54*a*. Ridge outer portion 102 forms a transition between midsection 104 and the adjacent field or, for the ridge 100 for fourth field 162, between the surface of field 62 and the terminal portions 66*a* and 67*b* at the closed ends 70.

FIG. 7 illustrates the preferred configuration of each field in a longitudinal cross section. Each field is sloped inwardly in a direction toward its closed end. For example, first field 56 of downwardly oriented element 54*b* is inclined downwardly and inwardly. Ridge 156 extends outwardly and second field 58 extends downwardly and inwardly from ridge 156. Likewise, ridge 158 extends outwardly and third field 60 extends downwardly and inwardly, ridge 160 extends outwardly and fourth field 62 extends downwardly to ridge 162. Each field is inclined at approximately 4 to 8 degrees. The present invention encompasses any orientation of the fields relative to a vertical axis.

Before hot filling or in its as-molded state, a tip of the closed end of third field 60 (that is, the flat portion of field 60 at its longitudinal centerline C adjacent inner portion 106 of ridge 160) is recessed relative to a tip of closed end of the second field 58 (that is, the flat portion of field 58 at its longitudinal centerline C adjacent inner portion 106 of ridge 158), and a tip of the closed end of the second field 58 (that is, the flat portion of field 58 at its longitudinal centerline C adjacent inner portion 106 of ridge 158) is recessed relative to a tip of closed end of the first field 56 (that is, the flat portion of field 56 at its longitudinal centerline C adjacent inner portion 106 of ridge 156).

The degree of recess of the tips preferably is small, such that a line drawn between the recessed tips (defined above) preferably is less than about 8 degrees, more preferably less than about 4 degrees, and may be zero or inclined opposite to that shown. The radial dimension of ridges 160 and 162 is large compared to the radial dimension of ridges 156 and 158 to compensate for the inward sloping of the fields.

The present invention is not limited to particular field or ridge configurations. For example, the present invention encompasses elements having any number of fields, structure that is outside of the outermost field, variations in field and element shape, and variations in ridge cross-sectional shape, as will be understood by persons familiar with hot-fill container technology.

Sidewall 48 of body 18 includes intermediate portion 64 that is generally vertical and located between adjacent elements 54, as best shown in FIG. 1. Upper terminal portions 66*a* and 66*b* are located on the sidewall 48 respectively above elements 54*a* and 54*b* The shape of upper terminal portion 66*a* has a shape for the upwardly oriented elements 54*a* and another shape 66*b* for downwardly oriented elements 54*b*. The shape of upper terminal portion 66*a* is in part defined by the closed end 70 of the elements 54*a*. The shape of upper terminal portion 66*b* is in part defined by the open end 72 of element 54*b*.

Lower terminal portions 67*a* and 67*b* are located respectively below elements 54*a* and 54*b*. The shape of lower terminal portion 67*a* has a shape for the upwardly oriented elements 54*a* and another shape 67*b* for downwardly oriented elements 54*b*. The shape of lower terminal portion 67*a* is in part defined by the open end 72 of the element 54*a* and the shape of lower terminal portion 67*b* is in part defined by the closed end 70 of element 54*b*.

Sidewall 48 also includes a sidewall transition portion 68 between upper terminal portion 66 of the closed end 70 and the intermediate portions 64. Preferably, sidewall portions 64, 66, and 68 smoothly merge into on another.

The inventors theorize that the open ends of each field 56, 58, 60, and 62 provide only a small amount of resistance to inward deflection about a horizontal axis while the ridges 156, 158, 160, and 162 maintain the attractive shape of elements and diminish the tendency of kinking or unsightly depressions in response to hot filling. Further, the ridges 100 are distributed to provide support throughout elements 54.

For container 10 having an even number of elements 54, the flared ends 90 and 92 extend outwardly toward the narrow, closed ends 70 of adjacent elements. For example, the right flared end 90 of downwardly directed element 54*a* shown in FIG. 2 extends rightward from a longitudinal centerline of element 54*a* toward the adjacent downwardly directed element 54*b*. Accordingly, flared end 90 extends into the space created by the narrowing of closed end 70. The ridge 100 at flared end 90 (and opposing flared end 92) supports to sidewall 48 in the region that would be otherwise unreinforced and that may be prone to high stress levels.

Figures 9A, 9B:
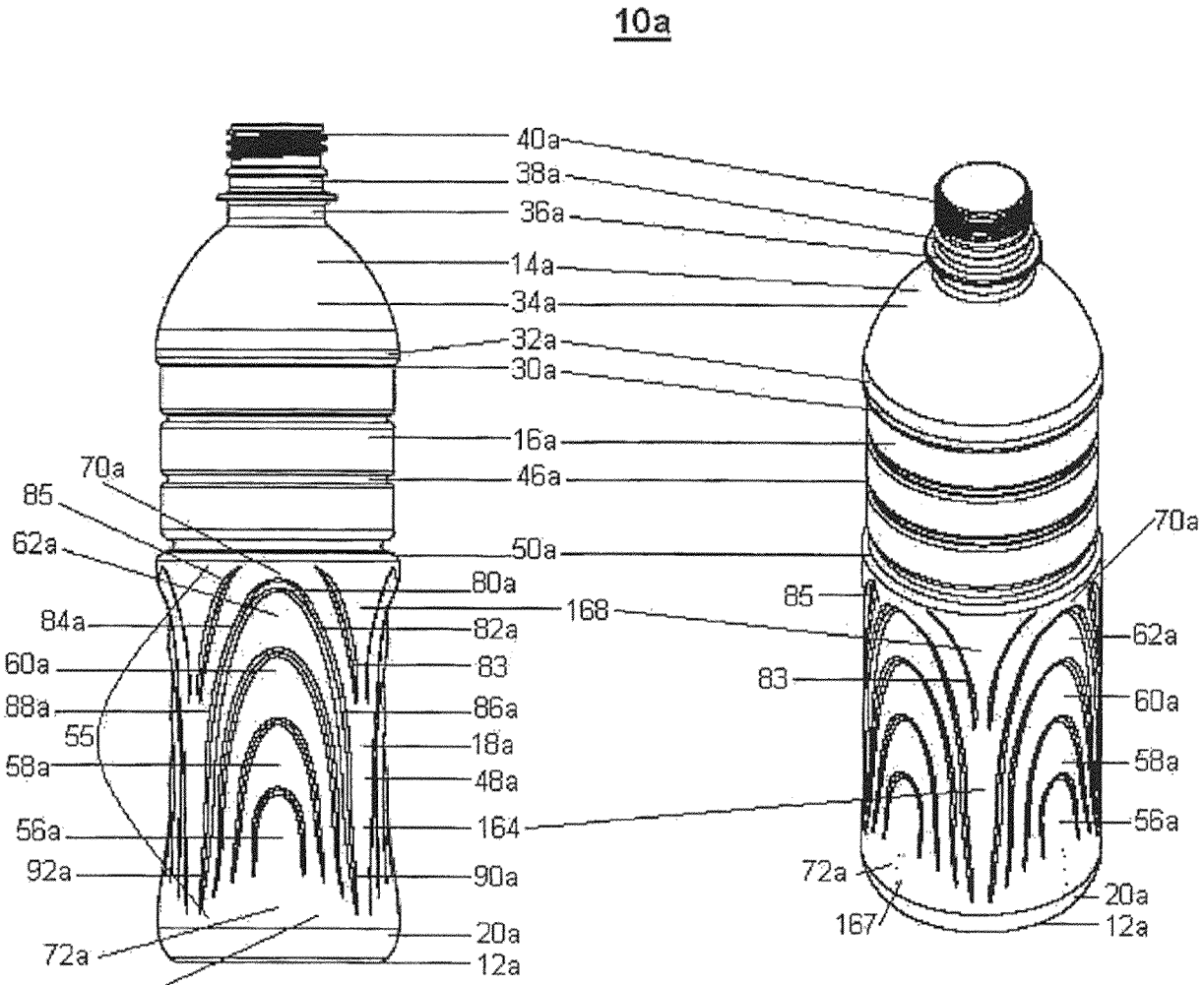
FIG. 9A is an elevational view of another container illustrating aspects of the present invention.
FIG. 9B is a perspective view of the container shown in FIG. 9A.

A second embodiment container 10*a* is illustrated in FIGS. 9A and 9B. Container 10*a* is capable of being hot filled and includes an enclosed base 12*a*, an upper portion 14*a*, a label panel 16*a* and a body 18*a*. Base 12*a*, upper portion 14*a* and label panel 16*a* are as described with respect to first embodiment container 10 and 10'.

Body 18*a* includes elements 55 that are all upwardly oriented. As shown, container 10*a* includes four upwardly-oriented elements 55 that are preferably evenly spaced around the sidewall 48*a* of the body 18*a* so that each element 55 is diametrically opposed by another element 55.

The shape of elements 55 is referred to herein as a V-shape, and the term V-shaped encompasses a closed end 70*a* that is pointed, a circular arc, or other curved shape having a curvature smaller or larger than that of a circular arc. The term V-shape encompasses any shape having one end that narrows relative to its midsection or generally considered to constitute a "V", and also encompasses sides that are mutually parallel or that extend outwardly from closed end 70*a*. The invention also encompasses elements that do not have a V-shape.

Each element 55 includes or is defined by a rounded tip 80*a*, a pair of opposing curved transition portions 82*a* and 84*a* that extend outwardly and downwardly from the tip 80*a*, a pair of lateral portions 86*a* and 88*a* that extend generally downwardly from transition portions 82*a* and 84*a*, and a pair of end portions 90*a* and 92*a*. that extend from lower ends of lateral portions 86*a* and 88*a*. Tip 80*a* and transition portions 82*a* and 84*a* define a closed end 70*a*. The spaced apart end portions 90*a* and 92*a* define an open end 72*a*. The present invention encompasses portions 90*a* and 90*b* being outwardly flared, approximately straight extensions of laterals portions 86*a* and 86*b*, and slightly inwardly directed.

Each element 55 includes a first field 56*a*, a second field 58*a*, and a third field 60*a*, and a fourth field 62*a*, each of which is as described with respect to first embodiment 10. The present invention is not limited to particular field or ridge configurations. For example, the present invention encompasses elements having any number of fields, structure that is outside of the outermost field, variations in field and element shape, and variations in ridge cross-sectional shape, as will be understood by persons familiar with hot-fill container technology.

Body 18*a* also includes a pair of eyebrows 83 and 85 disposed adjacent to the curved transition portions 82*a* and 84*a* at the closed end of each element 55. The eyebrows 83 and 85 are curved segments that generally follow the contour of the curved transition portions 82 and 84.

Sidewall 48*a* of body 18*a* includes intermediate portions 164*a* that is generally vertical and located between adjacent elements 55. Upper terminal portions 166*a* are located on the sidewall 48*a* respectively above elements 55. The shape of upper terminal portion 166*a* is in part defined by the closed end 70*a* of the elements 55. Lower terminal portions 167*a* are located respectively below elements 55. The shape of lower terminal portion 167*a* is in part defined by the open end 72*a* of the element 55. Sidewall 48*a* also includes a sidewall transition portion 168*a* between upper terminal portion 166*a* of the closed end 70*a* and the intermediate portions 164*a*. Preferably, sidewall portions 164*a*, 166*a*, and 168*a* smoothly merge into on another. Eyebrows 83 and 85 are located in intermediate sidewall portion 164*a* and upper sidewall portion 166*a*.

The inventors theorize that the open ends of each field 56*a*, 58*a*, 60*a*, and 62*a* provide only a small amount of resistance to inward deflection about a horizontal axis while the their ridges maintain the attractive shape of elements and diminish the tendency of kinking or unsightly depressions in response to hot filling.

Elements 55 narrow near tips 80*a*, and eyebrows 83 and 85 support upper sidewall portion 166*a* between the upper ends of adjacent elements 55. Eyebrows 83 and 85 are preferably defined by the same ridge 100 structure as the fields 56, 58, 60, and 62 described above. Thus, eyebrows 83 and 85 may support sidewall 48*a* in the region that would be otherwise unreinforced and that may be prone to high stress levels, which in some configurations and under some conditions may inhibit kinking upon hot filling. Although not shown in the figures, the present invention also encompasses elements 55 that are arranged about the sidewall and oriented with their open ends upwardly.

Figures 10A, 10B, 10C:
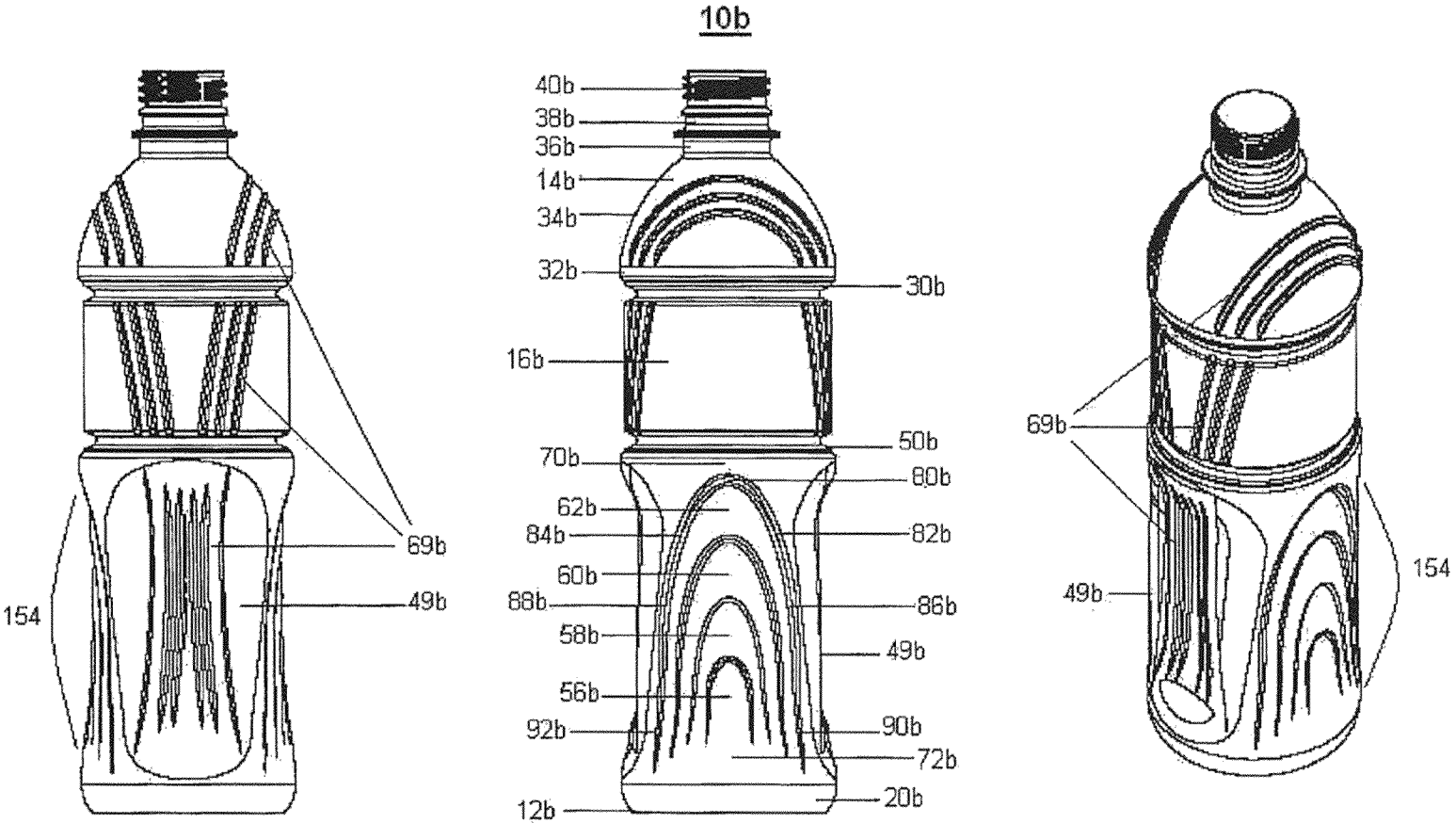
FIG. 10A is an elevational view of another container illustrating aspects of the present invention.
FIG. 10B is another elevational view of the container shown in FIG. 10A.
FIG. 10C is a perspective view of the container shown in FIG. 10A.

Referring to FIGS. 10A-10C, a third embodiment container 10*b* is shown. Container 10*b* is capable of being hot filled and includes an enclosed base 12*b*, an upper portion 14*b*, a label panel 16*b* and a body 18*b*. Base 12*b*, upper portion 14*b*, and label panel 16*b* are as described with respect to first embodiment container 10 and 10'. Body 18*b* includes elements 154 that are the same as elements 54 as described with respect to first embodiment containers 10 and 10'.

As shown, container 10*b* includes elements 154 that are all upwardly oriented and that are spaced apart around the sidewall 48*b* of the body 18*b* with panels 49*b* disposed between them. Container 10*b* preferably has two upwardly-oriented elements 154 and two panels 49*b* that are preferably evenly spaced around the sidewall 48*b* of the body 18*b* in an alternating arrangement. Further, the elements 154 are preferably diametrically opposed and the panels 49*b* are also preferably diametrically opposed. Alternatively, this embodiment may incorporate downwardly oriented elements 155 (as shown in FIGS. 11A-11C) instead of upwardly oriented elements 154 (as shown in FIGS. 10A-10C).

The panels 49*b* disposed between the elements 154 preferably have an inwardly concave surface as shown in FIG. 10B. Further, the panels 49*b* may include ornamental features 69*b* that are integrally formed on the sidewall 48*b* of the body 18*b*. For example, the ornamental features 69*b* may include arc segments of a rainbow as shown in FIGS. 10A and 10C. The arc segments of the rainbow extend vertically from the bottom to the top of one panel 49*b*, vertically across the label panel 16*b*, across the dome 34*b* on both sides of the neck 36*b*, and vertically from the top to the bottom of the other panel 49*b* to form the arcs of a rainbow. The arcs of the rainbow may be continuous or may be interrupted in the areas adjacent structural elements (e.g. upper 30*b* and lower 50*b* label bumpers) as shown in FIGS. 10A-10C. Again, in FIGS. 10A-10C, the container 10*b* is shown with ribs 46*b* on the label panel 16*b*, but the label panel 16*b* may be provided without the ribs 46*b*.

Figure 11C:
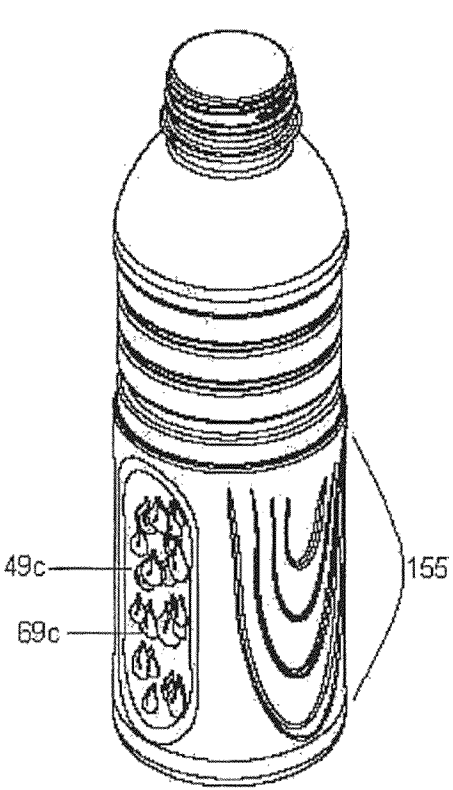
FIG. 11C is a perspective view of the container shown in FIG. 11A.
Figure 11B:
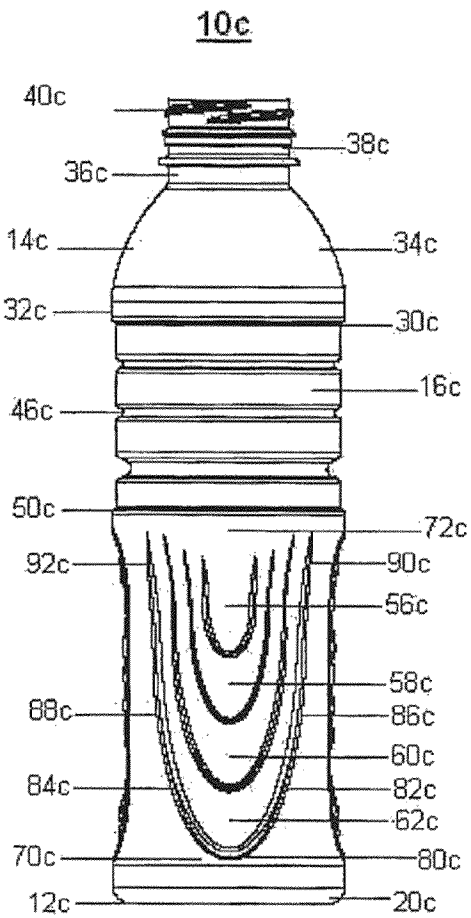
FIG. 11B is another elevational view of the container shown in FIG. 11A.
Figure 11A:
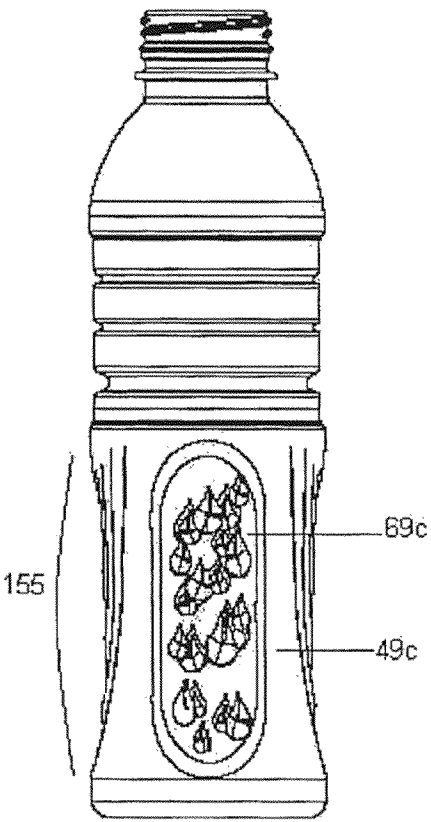
FIG. 11A is an elevational view of another container illustrating aspects of the present invention.

Referring to FIGS. 11A-11C, a fourth embodiment container 10*c* is shown. Container 10*c* is capable of being hot filled and includes an enclosed base 12*c*, an upper portion 14*c*, a label panel 16*c* and a body 18*c*, Base 12*c*, upper portion 14*c*, and label panel 16*c* are as described with respect to first embodiment container 10 and 10'. Body 18*b* includes elements 155 that are the same as elements 54 as described with respect to first embodiment containers 10 and 10'.

As shown, container 10*c* Referring to FIGS. 11A-11C, a fourth embodiment container 10*c* includes elements 155 that are spaced apart around the sidewall 48*c* of the body 18*c* with panels 49*c* disposed between them. Container 10*c* preferably has an even number of elements 155 and panels 49*c* that are evenly spaced around the sidewall 48*c* of the body 18*c* so that each element 155 is diametrically opposed by another element 155 and each panel 49*c* is diametrically opposed by another panel 49*c*. The panels 49*c* disposed between the elements 155 preferably have an inwardly concave surface as shown in FIGS. 11B, and may include ornamental features 69*c* such as raised water droplets shown in FIGS. 11A and 11C. Alternatively, this embodiment may incorporate upwardly oriented elements 154 (as shown in FIGS. 10A-10C) instead of downwardly oriented elements 155 (as shown in FIGS. 11A-11C). Again, in FIGS. 11A-11C, the container 10*c* is shown with ribs 46*c* on the label panel 16*c*, but the label panel 16*c* may be provided without the ribs 46*c*.

In operation, container 10 is capable of receiving a product at an elevated hot-fill temperature, such as approximately 185 degrees F. Preferably, container 10 is formed of a plastic having an intrinsic viscosity in the range typical for hot fill containers. Container 10 may be formed by any blow molding process, such as a two stage, stretch blow molding process with a heat setting stage. The present invention is not limited to this two stage process, but rather encompasses any process for making a container and any container that employs the general technology described herein. For example, the present invention encompasses any container having one or more vacuum compensation elements, or its equivalent, as described herein.

Figure 12:
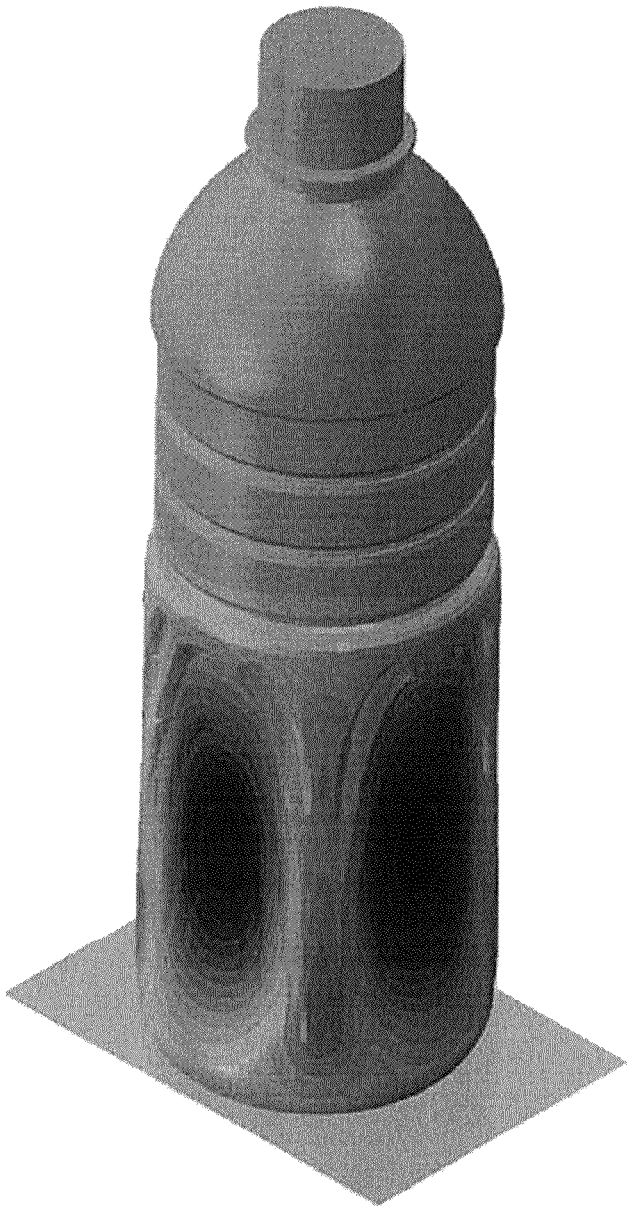
FIG. 12 is a plot of calculated deformation of the container shown in FIGS. 2 and 3 after hot filling.
Figure 13:
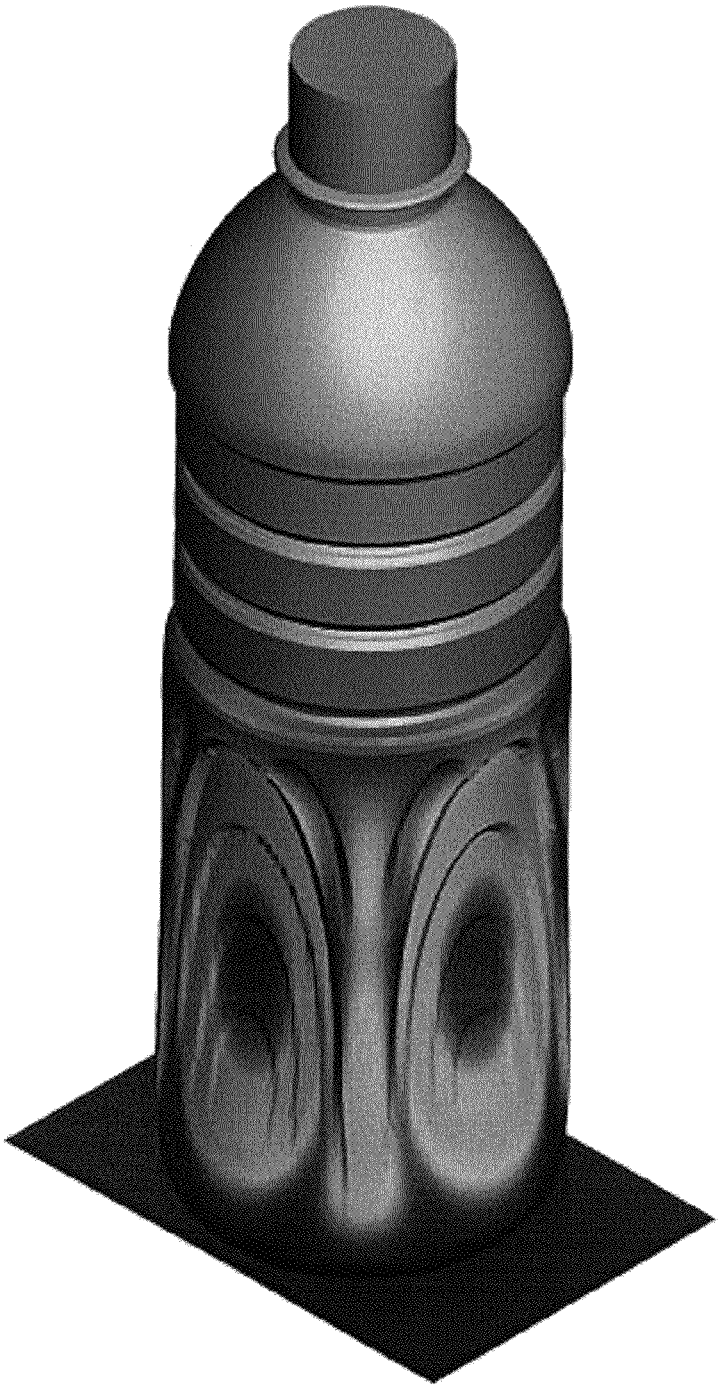
FIG. 13 is a plot of calculated deformation of the container shown in FIGS. 9A and 9B after hot filling.
Figure 14:
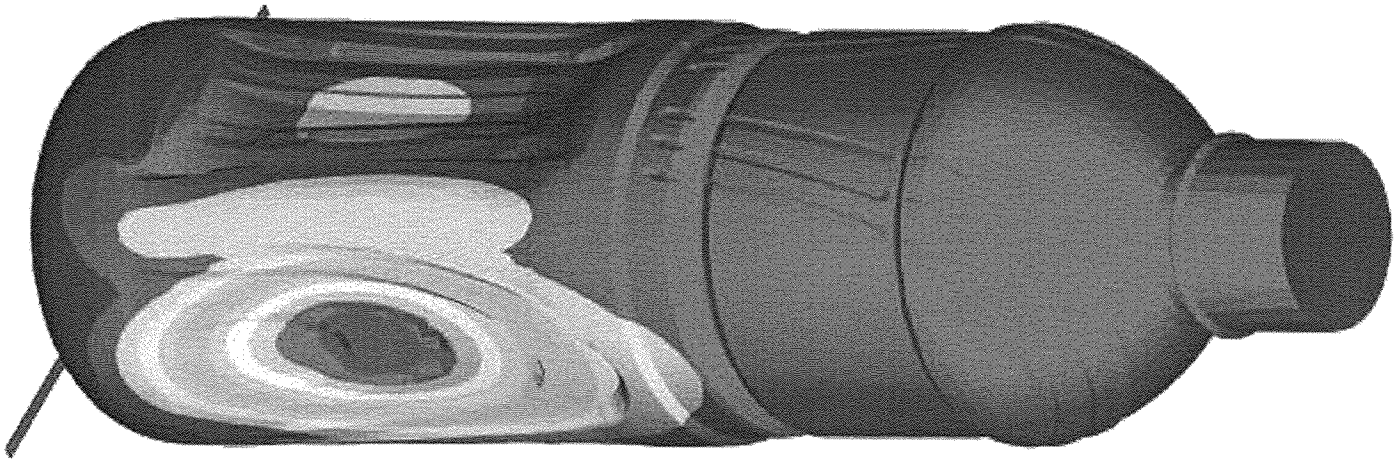
FIG. 14 is a plot of calculated deformation of the container shown in FIGS. 10A-10C after hot filling.

FIG. 12 illustrates the deformation of container 10 shown in FIGS. 2 and 3 after conventional hot-filling, in which the maximum deformation is roughly centered in second field 58 and roughly located on the longitudinal centerline of element 54. FIG. 13 illustrates the deformation of container 10*a* shown in FIGS. 9A and 9B after conventional hot-filling, in which the maximum deformation is roughly centered on element 55. FIG. 14 illustrates the deformation of container 10*b* shown in FIGS. 10A-10C after conventional hot-filling, in which the maximum deformation is roughly centered on element 154.

Upon capping during the hot-filling process, elements 54 are pulled inwardly in response to internal vacuum. Intermediate portions 64 after hot filling have an upright, straight shape to form posts. FIG. 9 indicates very little deformation in the posts. Because the face of elements 54 are roughly flat (in transverse cross section) after hot-filling, container 10 has a roughly box-like configuration in the center of body 18 while label panel 16 remains cylindrical.

The disclosure illustrates aspects of the present invention, which encompasses obvious variants of the disclosure as understood by persons familiar with container engineering and manufacturing.

What is claimed:

1. A plastic hot-fill bottle comprising: an enclosed base, an upper portion that extends upwardly to a finish; and a body located between the base and the upper portion, the body including a sidewall having an even number of circumferentially spaced, vacuum compensation elements, each one of the vacuum compensation elements generally having a V-shape and including a first ridge defining a first field, a second ridge defining a second field, and a third ridge defining a third field; the entire first ridge and first field being nested within the second ridge and second field, the entire second ridge and second field being nested within the third ridge and third field; the vacuum compensation elements being generally closed on one of an upper end and a lower end and generally open on the other one of the upper end and the lower end, wherein the vacuum compensation elements alternate upwardly oriented and downwardly oriented.

2. The bottle of claim 1 wherein the vacuum compensation elements alternate around a circumference of the body upwardly oriented and downwardly oriented.

3. The bottle of claim 1 wherein the open end of each vacuum compensation element is flared.

4. The bottle of claim 3 wherein the closed end of each one of the vacuum compensation elements includes a rounded tip, curved transition portions extending from the tip, and lateral portions that merge into the flared end portions.

5. The bottle of claim 1 wherein each one of the fields is generally V-shaped.

6. The bottle of claim 5 wherein each one of the fields has a closed end and opposing open end.

7. The bottle of claim 6 wherein the closed end of each one of the fields includes a rounded tip, a curved transition portion extending from the tip, a pair of lateral portions, and a pair of outwardly flared ends at the open end.

8. The bottle of claim 7 wherein each one of the tip, transition portions, and lateral portions of the fields are defined by ridges.

9. The bottle of claim 8 wherein, before hot filling, a tip of the closed end of third field is recessed relative to a tip of closed end of the second field, and a tip of the closed end of the second field is recessed relative to a tip of closed end of the first field.

10. The bottle of claim 9 wherein, before hot filling, the tip of the closed end of the first field is recessed relative to a circumference of the body.

11. The bottle of claim 6 wherein the entire area defined by the first field is located within the area defined by the second field, and the entire area defined by the second field is located within the area defined by the third field.

12. The bottle of claim 6 wherein the element further includes a fourth field, the third field is nested in the fourth field.

13. The bottle of claim 12 wherein, in response to internal vacuum pressure upon hot filling, the maximum region of inward deflection is located approximately in the second field.

14. The bottle of claim 6 wherein each one of the fields forms a face that is overall flat.

15. The bottle of claim 6 wherein the container has four vacuum compensation elements such that the container body is approximately square in transverse cross section before hot-filling.

16. The bottle of claim 6 wherein the container has four vacuum compensation elements such that the container body is approximately square in transverse cross section after hot-filling.

17. A plastic hot-fill bottle comprising: an enclosed base, an upper portion that extends upwardly to a finish; and a body located between the base and the upper portion, the body including a sidewall having at least one circumferentially spaced, vacuum compensation elements, each of said vacuum compensation elements including a first ridge defining a first field, a second ridge defining a second field, and a third ridge defining a third field; the entire first ridge and first field being nested within the second ridge and second field, the entire second ridge and second field being nested within the third ridge and third field; the vacuum compensation elements being generally enclosed on one of an upper end and a lower end and generally open on the other one of the upper end and the lower end, the element open end smoothly merging into the container sidewall, wherein the vacuum compensation elements alternate upwardly oriented and downwardly oriented.

18. The bottle of claim 17 wherein each one of the elements generally has a V-shape.

19. A plastic hot-fill bottle comprising: an enclosed base; an upper portion that extends upwardly to neck and a finish; and a body located between the base and the upper portion, the body including a sidewall comprising: at least two vacuum compensation elements; and at least two panels; wherein the vacuum compensation elements and panels are disposed around the circumference of the body in an alternating manner, each of said vacuum compensation elements generally having a V shape and including a first ridge defining a first field; a second ridge defining a second field; and a third ridge defining a third field; wherein the entire first ridge and first field is nested within the second ridge and second field, the entire second ridge and second field is nested within the third ridge and third field; and wherein the vacuum compensation elements are generally closed on one of an upper end and a lower end and generally open on the other one of the upper end and the lower end, wherein the vacuum compensation elements alternate upwardly oriented and downwardly oriented.

20. The bottle of claim 19 wherein the panels are concave.

21. A plastic hot-fill bottle comprising: an enclosed base, an upper portion that extends upwardly to a finish; and a body located between the base and the upper portion, the body including a sidewall having an even number of circumferentially spaced, vacuum compensation elements, each one of the vacuum compensation elements generally having a V-shape and including a first ridge defining a first field, a second ridge defining a second field, and a third ridge defining a third field; the entire first ridge and first field being nested within the second ridge and second field, the entire second ridge and second field being nested within the third ridge and third field; the vacuum compensation elements being generally closed on one of an upper end and a lower end and generally open on the other one of the upper end and the lower end, wherein each one of the fields has a closed end and opposing open end, and the closed end of each one of the fields includes a rounded tip, a curved transition portion extending from the tip, a pair of lateral portions, and a pair of outwardly flared ends at the open end, and each one of the tip, transition portions, and lateral portions of the fields are defined by said ridges, wherein, before hot filling, a tip of the closed end of third field is recessed relative to a tip of closed end of the second field, and a tip of the closed end of the second field is recessed relative to a tip of closed end of the first field.

22. The bottle of claim 21 wherein, before hot filling, the tip of the closed end of the first field is recessed relative to a circumference of the body.

23. A plastic hot-fill bottle comprising: an enclosed base, an upper portion that extends upwardly to a finish; and a body located between the base and the upper portion, the body including a sidewall having an even number of circumferentially spaced, vacuum compensation elements, each one of the vacuum compensation elements generally having a V-shape and including a first ridge defining a first field, a second ridge defining a second field, and a third ridge defining a third field; the entire first ridge and first field being nested within the second ridge and second field, the entire second ridge and second field being nested within the third ridge and third field; the vacuum compensation elements being generally closed on one of an upper end and a lower end and generally open on the other one of the upper end and the lower end, wherein each one of the fields has a closed end and opposing open end and the container has four vacuum compensation elements such that the container body is approximately square in transverse cross section before hot-filling.

24. A plastic hot-fill bottle comprising: an enclosed base, an upper portion that extends upwardly to a finish; and a body located between the base and the upper portion, the body including a sidewall having an even number of circumferentially spaced, vacuum compensation elements, each one of the vacuum compensation elements generally having a V-shape and including a first ridge defining a first field, a second ridge defining a second field, and a third ridge defining a third field; the entire first ridge and first field being nested within the second ridge and second field, the entire second ridge and second field being nested within the third ridge and third field; the vacuum compensation elements being generally closed on one of an upper end and a lower end and generally open on the other one of the upper end and the lower end, wherein each one of the fields has a closed end and opposing open end and the container has four vacuum compensation elements such that the container body is approximately square in transverse cross section after hot-filling.

* * * * *